US010453314B2

(12) United States Patent
San

(10) Patent No.: US 10,453,314 B2
(45) Date of Patent: Oct. 22, 2019

(54) GAMING MACHINE AND METHOD

(71) Applicant: Ainsworth Game Technology Limited, Newington (AU)

(72) Inventor: Kin Wai San, Maroubra (AU)

(73) Assignee: Ainsworth Game Technology Limited, Newington, NSW (AU)

( * ) Notice: Subject to any disclaimer, the term of this patent is extended or adjusted under 35 U.S.C. 154(b) by 72 days.

(21) Appl. No.: 15/265,648

(22) Filed: Sep. 14, 2016

(65) Prior Publication Data

US 2018/0075708 A1 Mar. 15, 2018

(51) Int. Cl.
*G07F 17/34* (2006.01)
*G07F 17/32* (2006.01)

(52) U.S. Cl.
CPC ..... *G07F 17/34* (2013.01); *G07F 17/3206* (2013.01); *G07F 17/3209* (2013.01); *G07F 17/3213* (2013.01); *G07F 17/3246* (2013.01); *G07F 17/3251* (2013.01); *G07F 17/3258* (2013.01)

(58) Field of Classification Search
CPC .. G07F 17/34; G07F 17/3206; G07F 17/3209; G07F 17/3213; G07F 17/3246; G07F 17/3251; G07F 17/3258
USPC ..... 463/20
See application file for complete search history.

(56) References Cited

U.S. PATENT DOCUMENTS 5,851,147 A 12/1998 Stupak et al.
6,146,271 A * 11/2000 Kadlic ..... A63F 1/00 273/292
6,224,483 B1 5/2001 Mayeroff
6,224,484 B1 5/2001 Okuda et al.
6,319,125 B1 11/2001 Acres
6,752,395 B2 6/2004 Jones et al.
9,171,423 B2 10/2015 O'Halloran et al.
2002/0045474 A1* 4/2002 Singer ..... G07F 17/32 463/20
2004/0198481 A1* 10/2004 Herrington ..... G07F 17/32 463/13
2005/0208990 A1 9/2005 Moore
2006/0105836 A1* 5/2006 Walker ..... G07F 17/32 463/25
2006/0253324 A1 11/2006 Miller
(Continued)

FOREIGN PATENT DOCUMENTS

AU 2007221772 4/2008

*Primary Examiner* — David Duffy
*Assistant Examiner* — Ankit B Doshi
(74) *Attorney, Agent, or Firm* — Cook Alex Ltd.

(57) ABSTRACT

The invention provides a gaming machine comprising a display for displaying a game comprising the display of randomly selected game symbols and where predetermined winning combinations of the randomly selected game symbols in the game award prizes to a player. A game controller controls the display of the game symbols on the display and determines whether a trigger event has occurred in the play of the game. The trigger event has a probability with a probability component that is independent of the value received from the player. Upon occurrence of the trigger event, the game controller offers a plurality of bonus prizes for selection by the player. Once the player selects a bonus prize, the game controller causes the selected bonus prize to only be available during play of the game. A method is also provided.

17 Claims, 7 Drawing Sheets

(56) References Cited

U.S. PATENT DOCUMENTS

| | | | | |
|---|---|---|---|---|
| 2006/0281527 | A1 | 12/2006 | Dunaevsky et al. | |
| 2007/0060318 | A1 | 3/2007 | O'Halloran et al. | |
| 2007/0072668 | A1 | 3/2007 | Hein et al. | |
| 2009/0227354 | A1 | 9/2009 | Johnson | |
| 2010/0124972 | A1* | 5/2010 | Rodgers | G07F 17/34 463/20 |
| 2010/0137056 | A1* | 6/2010 | Hoffman | G07F 17/32 463/21 |
| 2011/0218027 | A1 | 9/2011 | Manz et al. | |
| 2012/0122545 | A1 | 5/2012 | Watkins et al. | |
| 2013/0225251 | A1 | 8/2013 | Baerlocher et al. | |
| 2014/0302909 | A1 | 10/2014 | Meyer | |
| 2016/0110958 | A1 | 4/2016 | Meyer | |

* cited by examiner

GAMING MACHINE AND METHOD

BACKGROUND

The present invention relates to a gaming machine. The invention has been developed primarily for use as an electronic gaming machine and will be described hereinafter by reference to this application. However, it will be appreciated that the invention may also be implemented for any type of gaming machine, including a mechanical or electro-mechanical gaming machine.

The following discussion of the prior art is intended to present the invention in an appropriate technical context and allow its advantages to be properly appreciated. Unless clearly indicated to the contrary, however, reference to any prior art in this specification should not be construed as an express or implied admission that such art is widely known or forms part of common general knowledge in the field.

Conventional gaming machines typically involve awarding prizes to a player according to predetermined combinations of game symbols that appear on an array of game squares displayed on a screen, typically organised into three rows and five columns (a 5×3 array). Other arrays, such as a 3×3 or 4×3, may be used. Each gaming machine randomly selects the game symbols that appear on the array, each column of the array being a "reel".

One type of gaming machine comprises a mechanical or electro-mechanical device, where a motor rotates a plurality of annular rings or drums that form reels. Each reel has a reel strip that displays game symbols in preset game symbol positions. A frame covers the rings to provide a window through which only a subset of game symbol positions (and hence game symbols) were visible to the player. Thus, for a game using a 5×3 array, the window would only permit three rows of five rings to be visible to create the game array. An internal game controller within the gaming machine controls operation of the motor and hence rotation of the reels. Thus, by controlling when each reel starts and stops in its respective rotation, the game controller controls the display of the game symbols in the window. Sensors linked to the reels indicate which game symbols are displayed in the window and communicate with the game controller so that the game controller is able to award prizes based on winning combinations of game symbols displayed on the reels in the window. The game controller typically comprises one or more electric circuits for controlling various functions of the gaming machine, such as the above mentioned control of the motor, communicating with the sensors, verifying that the correct amount of a bet has been made via one or more value receiving mechanisms to enable operation of the motors, controlling any visual and/or audio effects associated with operation of the gaming machine and controlling operation of various alarms to alert any tampering with the gaming machine.

Another type of gaming machine, known as an electronic gaming machine or EGM, replaces the mechanical reels and motor with a video display screen on which video images of the reels are displayed. The EGM has an internal electronic game controller, typically a computer, that controls the display of images on the video display screen so that the reels are visibly spun on the screen to simulate a physical reel of a traditional gaming machine. EGMs tend to be more versatile in providing game information, varying the probabilities for a player to win a prize and varying the type of game that is played.

Bonus or "feature" games may also be provided by a gaming machine in addition to a base or main game.

Typically feature games use the same set of reels as the main game and are limited to a set of free games operated under a single set of rules. This means that the feature game is restricted by the same set of rules, and so there is no variation in the play of the feature game.

Also, gaming machines can offer one or more bonus prizes to the player during play of the game. The most common type of bonus prize that is awarded by the gaming machine is a jackpot prize, the main example of which is a progressive jackpot prize. However, in order to provide multiple jackpot or bonus prizes, the gaming machine has to reduce the "return to player" or RTP for the base game and any feature games to compensate for the RTP of each bonus prize that is offered. This standard structure to providing bonus prizes is inefficient as not all the bonus prizes may be available for every game played on the gaming machine. For example, some bonus prizes only available if the player bets a threshold amount. Also, where more than one game is offered to play on the same electronic gaming machine some bonus prizes are tied to a particular game or set of games and not all the games offered on the gaming machine. This inefficiency limits the operation of the gaming machine, irrespective of whether it is a mechanical, electro-mechanical or electronic gaming machine.

It is an object of the present invention to overcome or substantially ameliorate one or more of the disadvantages of prior art, or at least to provide a useful alternative.

SUMMARY

The present invention provides a gaming machine that has improved operation and performance relative to existing prior art gaming machines by providing a more efficient way of awarding bonus or jackpot prizes to a player of the gaming machine compared to presently existing gaming machines. The present invention also improves the application of a game controller in playing the game on the gaming machine.

One embodiment of the invention provides a gaming machine comprising:

a display for displaying a game, wherein said game comprises randomly selected game symbols and where predetermined winning combinations of said randomly selected game symbols in said game award prizes to a player; and a game controller for controlling the display of said game symbols on said display;

wherein said game controller determines whether a trigger event has occurred in said play of said game, said trigger event having a probability with a probability component that is independent of the value received from said player;

upon occurrence of said trigger event, said game controller offers a plurality of bonus prizes for selection by said player;

said player selects a first bonus prize of said bonus prizes; and said game controller causes said first bonus prize to only be available during play of said game.

Another embodiment of the invention provides a gaming machine comprising:

a display for displaying a game, wherein said game comprises randomly selected game symbols and where predetermined winning combinations of said randomly selected game symbols in said game award prizes to a player; and a game controller for controlling the display of said game symbols on said display, wherein said game controller is configured to:

randomly select said game symbols for display in said game;

causing said display to display said randomly selected game symbols;

determining whether a trigger event has occurred in said play of said game, said trigger event having a probability with a probability component that is independent of the value received from said player;

in response to occurrence of said trigger event, offering a plurality of bonus prizes for selection by said player, receiving a selection of a first bonus prize by said player; and causing said first bonus prize to only be available during play of said game.

A further embodiment of the invention provides a gaming machine comprising:

a display for displaying a game, wherein said game comprises randomly selected game symbols and where predetermined winning combinations of said randomly selected game symbols in said game award prizes to a player;

a game controller for controlling the display of said game symbols on said display; and a value transfer mechanism for receiving value from said player, wherein said game controller communicates with said value transfer mechanism such that when a threshold amount of value has been received from said value transfer mechanism, said game controller initiates a play of said game;

wherein said game controller determines whether a trigger event has occurred in said play of said game, said trigger event having a probability with a probability component that is independent of the value received from said player;

upon occurrence of said trigger event, said game controller offers a plurality of bonus prizes for selection by said player;

said player selects a first bonus prize of said bonus prizes; and said game controller causes said first bonus prize to only be available during play of said game.

Yet another embodiment of the invention provides a method of awarding a bonus prize during operation of a gaming machine comprising a display and a game controller, the method comprising:

controllably displaying game symbols for playing a game, wherein said game comprises game symbols and predetermined winning combinations of randomly selected game symbols award prizes to a player;

randomly selecting said game symbols for display in said game;

displaying said randomly selected game symbols;

determining whether a trigger event has occurred in said play of said game, said trigger event having a probability with a probability component that is independent of the value received from said player;

in response to occurrence of said trigger event, offering a plurality of bonus prizes for selection by said player;

receiving a selection of a first bonus prize by said player; and causing said first bonus prize to only be available during play of said game.

A yet further embodiment of the invention provides a method for a gaming machine comprising a display for displaying a game, a game controller for controlling the display of said game symbols for playing said game on said display; and a value transfer mechanism for receiving value from said player to initiate a play of said game, the method comprising:

said value transfer mechanism receiving value from said player;

determining whether said received value meets a threshold amount;

initiating a play of said game if said received value is equal to or greater than said threshold amount;

controllably displaying game symbols for playing said game, wherein said game comprises predetermined winning combinations of randomly selected game symbols award prizes to a player;

randomly selecting said game symbols for display in said game;

displaying said randomly selected game symbols;

determining whether a trigger event has occurred in said play of said game, said trigger event having a probability with a probability component that is independent of the value received from said player;

in response to occurrence of said trigger event, offering a plurality of bonus prizes for selection by said player;

receiving a selection of a first bonus prize by said player; and causing said first bonus prize to only be available during play of said game.

Yet another embodiment of the invention provides a method of operating a gaming machine comprising a display and a game controller, the method comprising:

said game controller communicating with said display to controllably display game symbols for playing a game, wherein said game comprises predetermined winning combinations of randomly selected game symbols award prizes to a player;

said game controller randomly selecting said game symbols;

said display displaying said randomly selected game symbols in an array of game positions;

said game controller determining whether a trigger event has occurred in said play of said game, said trigger event having a probability with a probability component that is independent of the value received from said player;

in response to occurrence of said trigger event, said game controller offering a plurality of bonus prizes for selection by said player;

said game controller receiving a selection of a first bonus prize by said player, and said game controller causing said first bonus prize to only be available during play of said game.

Yet another embodiment of the invention provides a method for a gaming machine comprising a display for displaying a game, a game controller for controlling the display of said game symbols for playing said game on said display; and a value transfer mechanism for receiving value from said player to initiate a play of said game, the method comprising:

said value transfer mechanism receiving value from said player;

determining whether said received value meets a threshold amount;

said game controller initiating play of said game if said received value is equal to or greater than said threshold amount;

said game controller controllably displaying game symbols for playing said game, wherein said game comprises predetermined winning combinations of randomly selected game symbols award prizes to a player;

said game controller randomly selecting said game symbols;

said display displaying said randomly selected game symbols in an array of game positions;

said game controller determining whether a trigger event has occurred in said play of said game, said trigger event having a probability with a probability component that is independent of the value received from said player;

in response to occurrence of said trigger event, said game controller offering a plurality of bonus prizes for selection by said player;

said game controller receiving a selection of a first bonus prize by said player; and said game controller causing said first bonus prize to only be available during play of said game.

A further embodiment of the invention provides a computer system comprising a central processing unit configured for communication with a gaming machine, wherein said computer system is configured to perform the method of any one of the above described embodiments of the invention.

A further embodiment of the invention provides a computer programme configured to perform the method of any one of the above described embodiments of the invention.

A further embodiment of the invention provides a non-transitory carrier medium carrying computer executable code that, when executed on a central processing unit configured for communication with a gaming machine, causes the central processing unit to perform the method of any one of the above described embodiments of the invention.

Throughout the specification and unless explicitly stated otherwise, the term "value" means credits, gaming tokens, coins, paper, currency, tickets, vouchers, credit cards, debit cards, smart cards, memory devices capable of storing value and any other object representative of value.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Furthermore, as used herein and unless otherwise specified, the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

Preferred embodiments of the invention will now be described, by way of example only, with reference to the accompanying drawings in which.

DETAILED DESCRIPTION OF VARIOUS EMBODIMENTS

Figure 1:
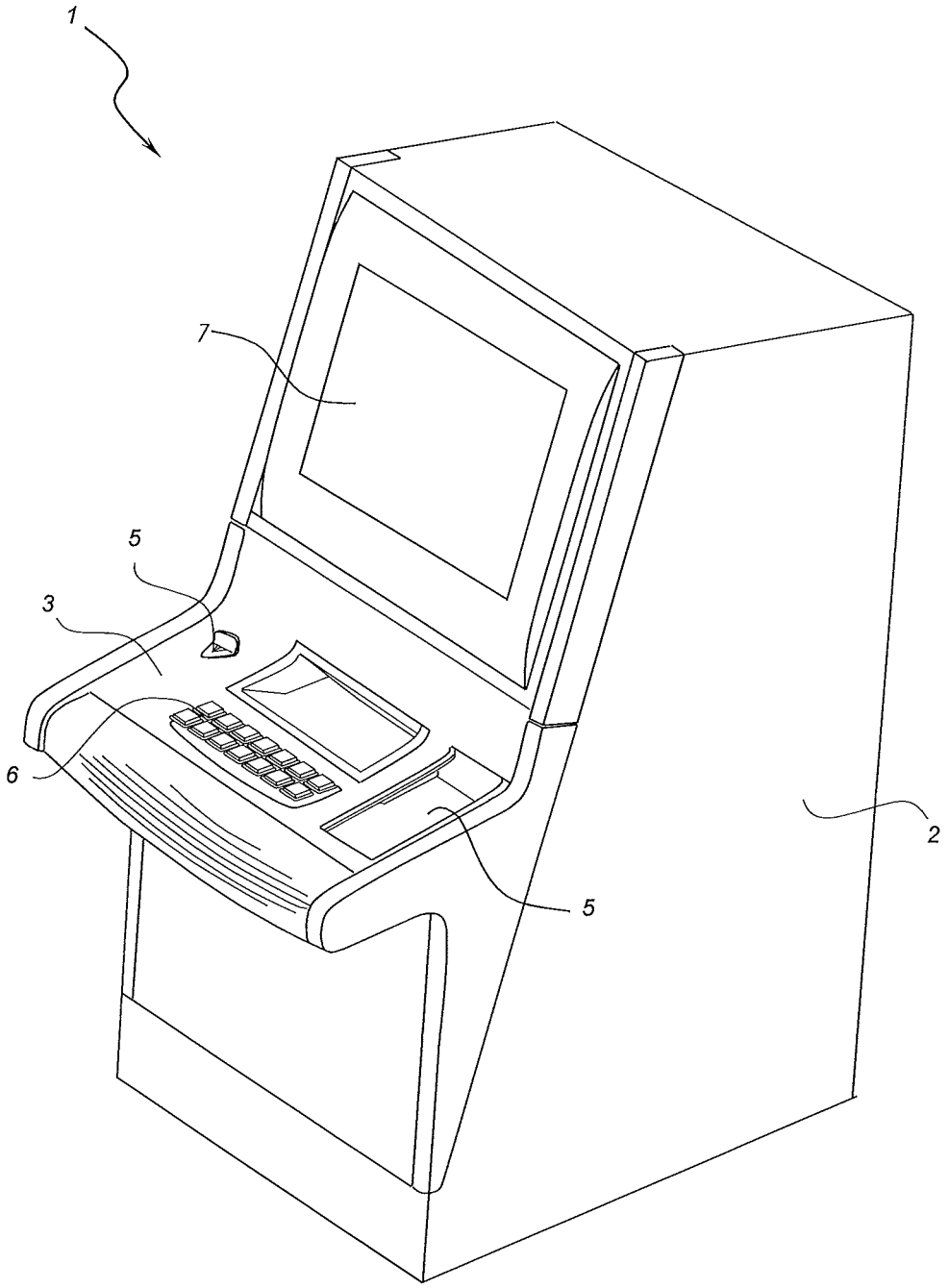
FIG. 1 is a perspective view of a gaming machine according to a first embodiment of the invention.

The present invention will now be described with reference to the following examples which should be considered in all respects as illustrative and non-restrictive. In the Figures, corresponding features within the same embodiment or common to different embodiments have been given the same reference numerals.

Referring to FIG. 1, a gaming machine 1 according to a first embodiment of the invention includes a cabinet 2, a console 3 and an internal game controller 4. The console 3 has various input devices including vending slots 5 for receiving monetary bets and a plurality of buttons 6 for actuation by a player. It will be appreciated that in other embodiments the vending slots 5 may be replaced with other types of value input/value output devices, such as a coin acceptor, a paper currency acceptor, a ticket reader and/or printer or a card reader and/or writer.

The vending slots 5 can be configured to receive value, such as cash in the form of banknotes and coins, or credits representing a monetary amount from a memory device, such as but not limited to a memory card, smart card, a radio frequency identification (RFID) device, USB key, magnetic card or other electronic storage device. Typically, the memory device is a credit card, debit card or other card that enables the transfer of monetary credit to the gaming machine 1. Other forms of value include gaming tokens, paper, tickets, vouchers, and any other object representative of value.

Figure 2:
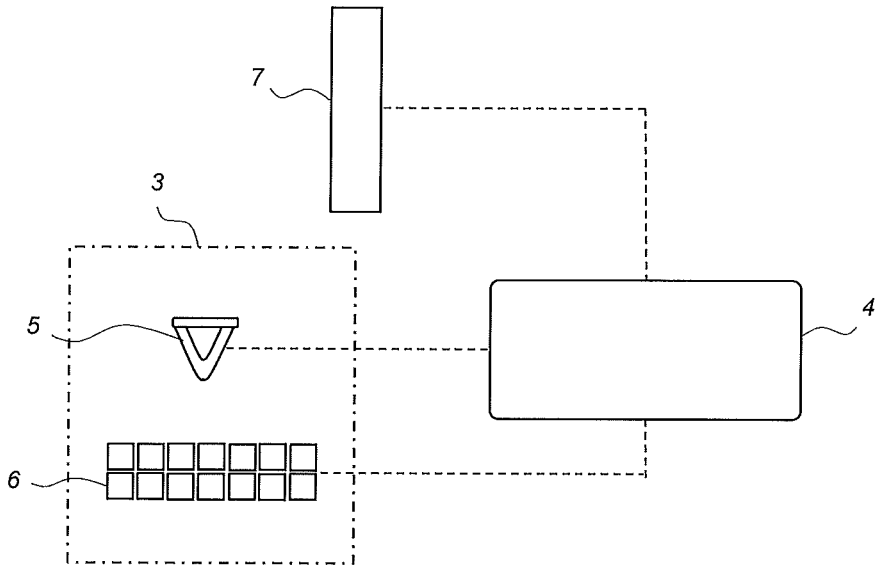
FIG. 2 is a schematic drawing of a game controller for the gaming machine of FIG. 1.

The game controller 4 is generally in the form of an electronic game controller comprising a central processing unit, such as a computer, and is in electronic communication with a display in the form of a video display screen 7, as well as various input devices on the console 3, as best shown in FIG. 2. Typically, the electronic game controller 4 also comprises a random access memory (RAM) associated with the central processing unit, the RAM being used to store programme instructions and transient data related to the operation of the electronic game controller and hence the gaming machine 1. The RAM contains a body of program instructions for implementing a game on the gaming machine 1, as discussed in more detail below. The central processing unit or processor may also be operatively associated with a further storage device, such as a hard disk drive, which is used for long-term storage of program components and data relating to the electronic game controller 4 and/or the gaming machine 1, including a database for game performance data, as well as information gathered from users. It is also appreciated that a person skilled in the art would readily understand the location and use of the electronic game controller 4 in the gaming machine 1.

The electronic game controller 4 will transmit and receive signals to and from each of the input devices and the display 7, usually via wired connections but can include wireless modes of electronic communication, such as WLAN. In the case of the vending slots 5 (or with any other type of value transfer mechanism), there may be an intermediate credit verification device that examines and verifies the cash or credits received by the vending slots. Once the value (such as cash or credits) have been verified by the credit verification device, a signal is sent to the electronic game controller 4, which then determines whether the minimum bet level has been reached. If so, the electronic game controller 4 will permits play of the game on the gaming machine 1. If not, the electronic game controller 4 will send a signal to the display 7 to show a message requesting further value to be added to the gaming machine 1.

Figure 3:
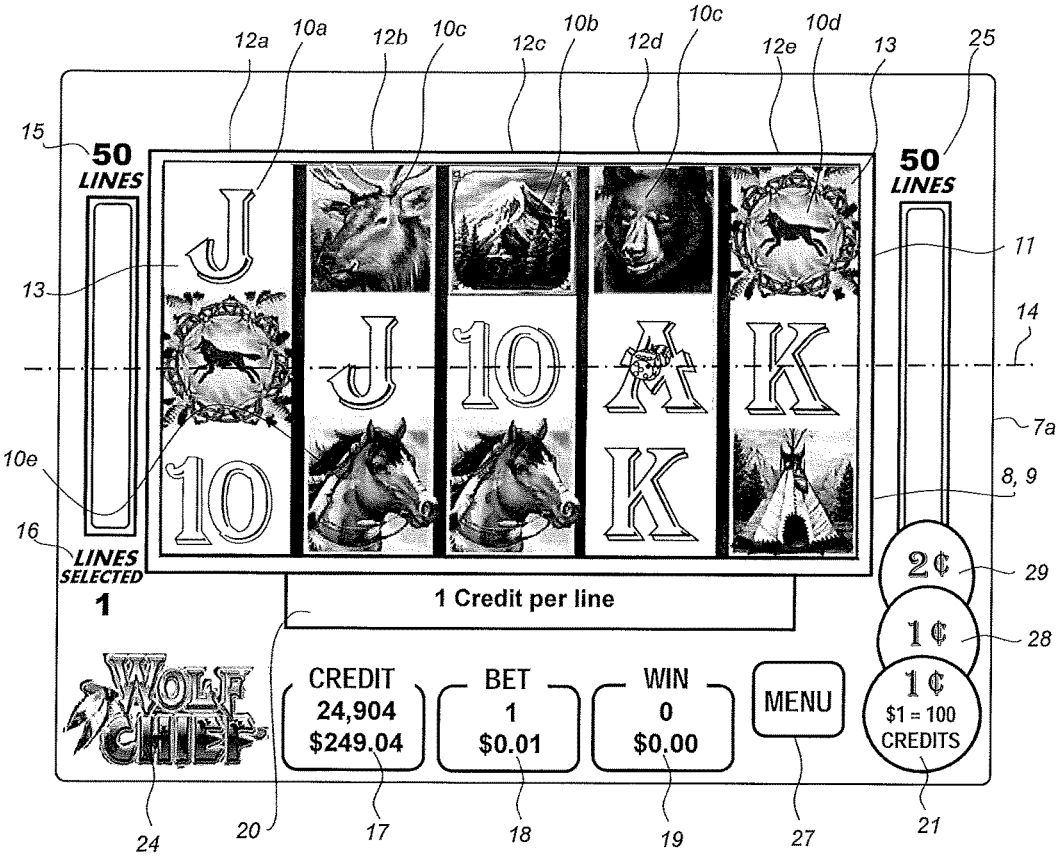
FIG. 3 is a front view of the display of the gaming machine of FIG. 1 illustrating a game.
Figure 4:
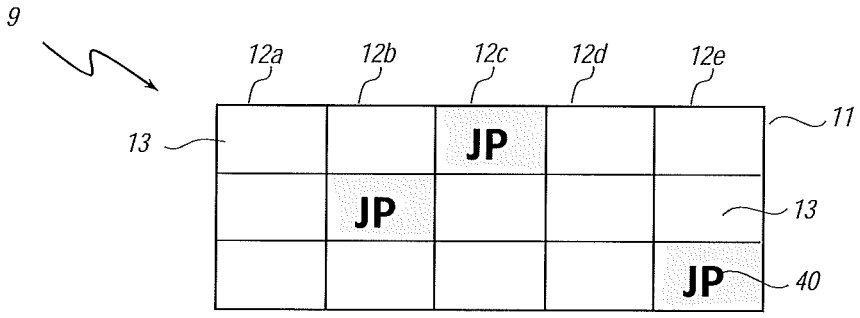
FIG. 4 is a schematic drawing of a game shown on the gaming machine of FIG. 1.

The electronic game controller 4 is programmed to provide a game in the form of a base game 8 (as best shown in FIG. 3) and a feature game 9 (as best shown in FIG. 4 to) on a lower playing area 7*a* of the display 7 of the gaming machine 1 for play by a player. An upper display area 7*b* (not shown) is reserved for showing artwork associated with the game(s) that are available for play on the gaming machine and/or other game information. The base game 8 has game symbols 10 arranged into an array 11 in the form of five columns or "reels" 12. The reels 12 give the visual appearance of rotating, typically by having the game symbols 10 move in a downward linear path along the length of each reel 12. While the array 11 is arranged with five reels 12 and three rows as per the industry standard, it will be appreciated by one skilled in the art that other types of arrays could be used, such as 3×3, 4×3, 5×5, 4×4, etc, including arrays having an irregular number of rows and/or columns. For example, the array 11 can have an unequal number of rows and/or columns, where some columns have less or more rows than other columns or where some rows have less or more columns than other rows. A more specific example would be an array having three columns with only two rows and two columns with three rows. The electronic game controller 4 will transmit signals to the display screen 7 to cause the base game 8 and feature game 9 to be played on the lower playing area 7*a*, including showing the game symbols 10, array 11 and other visible elements of the games.

The array 11 of the base game 8 defines predetermined game or symbol positions 13, in which the game symbols 10 appear. The symbol positions 13 are not visually marked by boundary lines and simply provide an area for the game symbols 10 to appear. However, it will be appreciated that in other embodiments, the symbol positions 13 are defined by visible boundary lines (to define "squares" or game positions) or other markings to define each respective area of the symbol positions.

The array 11 is arranged so that a player can select one or more predetermined "pay lines" 14 defined around the array, which correspond to combinations of the symbol or game positions 13. The pay lines 14 correspond to the lines selected by the player and generally comprise at least one game position or symbol position 13 from each reel 12. The number of pay lines 14 that can be selected by the player depends on the amount of the monetary bet for playing a game on the array 11. In the base game 8, predetermined winning combinations of randomly selected game symbols 10 result in the award of prizes to the player.

The game symbols 10 can include a mixture of picture symbols (such as animal symbols or playing card symbols), word symbols, scatter symbols, substitute or wild card symbols and trigger symbols to trigger the feature game 9. Those skilled in the art will readily understand that a substitute symbol is able to act as any other game symbol, and hence is also known as a "wild card" symbol. Likewise, those skilled in the art will readily understand that a scatter symbol is a symbol that triggers a game event or confers an award without having to appear on a player-selected pay line 14. Similarly, a trigger symbol is a symbol that triggers a game event or confers an award, where the trigger symbol may or may not have to appear in combination and may or may not have to appear on the same player-selected pay line 14. In this embodiment, the game symbols 10 include playing card symbols 10*a*, item-themed symbols 10*b*, animal-themed symbols 10*c*, scatter symbols in the form of wolf logo symbols 10*d* and a substitute or wild card symbol in the form of horse symbols 10*e*. The electronic game controller 4 randomly determines the appearance of the game symbols 10 on the array 11.

The video screen 7 also displays other standard game information including the amount of player credits 17, the amount of the current bet wagered by the player 18, the amount of wins by the player 19, a message area 20, a current denomination button 21 indicating the currently selected base bet denomination, the name 22 of the game that the base game 8 belongs to, being Wolf Chief™, the number of pay lines available 25 and the number of player-selected pay lines 26. The video screen 7 also displays a menu button for bringing up a menu screen 27 (typically explaining the game rules and showing the available pay lines 14), any denomination images 28, 29 that "pop" up when the denomination button 21 is selected and/or jackpot information relating to the base game 8 and feature game 9 that are awarded by the electronic gaming machine (EGM) 1. This jackpot information is typically displayed in the upper display area and can comprise, in descending order of monetary value, a grand jackpot, major jackpot, minor jackpot and midi jackpot.

In the base game 8, the player initially makes a bet using vending slots 5 to initiate play of the gaming machine 1 by building up credit to play the base game 8 on the gaming machine. For example, the player can bet or wager monetary amounts equivalent to a particular amount of credits, depending on the bet denomination selected for the base game. Also, the player can make any additional side bets or ante-bets during play of the base game 8 once the base game has commenced to access additional features in the base game, such as increasing the number of winning combinations in the base game.

Typically, gaming machines offer a number of preset bet options that the player can make, and these bet options can vary depending on the game or games offered on the gaming machine. For example, a game on a gaming machine may provide bet options of 1 credit, 2 credits, 5 credits and 10 credits per player-selected pay line 14. In another example, the player may bet 1 credit, 2 credits, 5 credits and 10 credits for a preset group or combination of pay lines 14, such as a group of 5 pay lines, 10 pay lines, 20 pay lines, etc.

The gaming machine 1 also has a default bet denomination, which is usually the bet denomination that was previously used in the preceding play of the base game 8. For example, if a person had played the base game 8 with a bet denomination of 5¢, then this would be the default bet denomination for the player when he or she commences play of the game. Where the gaming machine has not yet been played or has been started up, the default bet denomination is initially selected by the electronic game controller 4. The default bet denomination can be randomly selected or chosen according to a predetermined order. Usually, the electronic game controller 4 will select the bet denomination with the lowest value that is available for the base game 8, which would be the 10 bet denomination for this embodiment. The player may change the bet denomination at any time in the base game 8 by touching the denomination button 21 before or after the reels 12 have spun. In this embodiment, touching the denomination button will bring denomination images that the player may select to quickly change the bet denomination between plays of the game 8.

Once the player has commenced play of the game 8 by making an appropriate bet via the vending slots 5, the electronic game controller 4 then commences a play of the base game 8 by sending a signal to the display 7 to cause the reels 12 to appear to visibly rotate or "spin" in a linear path, typically in a downward vertical direction, and randomly display the game symbols 10 in each game position for each play of the array 11 for the base game 8. After the reels 12 stop spinning (and thus ends the spin or play of the base game 8), the electronic game controller 4 determines whether there are any predetermined winning combinations of the game symbols 10 appearing in any player-selected pay lines 14, such as a two of a kind, three of a kind, four of a kind or five of a kind for all the game symbols 10 and other combinations of a "full house", "straight" or "flush" for the playing card game symbols 10*a*. It will be appreciated that other winning combinations of game symbols 10 can also be provided. If so, the gaming machine 1 enters a winning game state and awards a prize according to the displayed predetermined winning combination.

The electronic game controller 4 also determines whether the feature game 9 should be activated, based on a predetermined trigger event, such as the appearance of a number of trigger symbols appearing in a play or spin of the base game 8. In this embodiment, the trigger event is the appearance of three scatter symbols 10*d*. The scatter symbols 10*d* need not appear on the same pay line 14, but can appear on any of the player-selected pay lines.

In response to the trigger event, the electronic game controller 4 then transmits a signal to the video screen 7 to cause the feature game 9 to appear on the video screen 7. In this embodiment, the feature game 9 uses the same game symbols 10 as the base game 8, as well as the same array 11, reels 12, game positions 13 and player-selectable pay lines 14 on the video screen 7. Hence, the feature game 9 is the essentially the same in general appearance as the base game shown in FIG. 3. In the feature game 9, ten free plays or spins of the feature game are awarded to the player without having to make an additional bet or wager. It will be understood by those skilled in the art that a free play or spin involves a play of the game without requiring any bet to be made by the player, and that any number of free spins can be chosen for the feature game 9. In addition, it will be appreciated that in the art free spins are commonly referred to as "free games". The number of free games remaining in the feature game 9 is indicated by a counter (not shown). Typically, the prizes awarded for the same winning combinations of game symbols in the feature game 9 are of higher value than the prizes awarded in the base game 8.

The feature game 9 operates in a similar manner to the base game 8, where the reels 12 visibly rotate and display randomly selected game symbols 10 in each game position 13, as best shown in FIG. 3. Predetermined winning combinations of randomly selected game symbols 10 in the array 11 of the feature game 9 also result in the award of prizes to the player, usually of an enhanced value compared to the prizes awarded in the base game 8.

In this embodiment, there is also a trigger event in the feature game 9 that allows the player to access a jackpot feature game once certain conditions or eligibility criteria are met. Initially, the eligibility criteria comprise having three specific reels display a jackpot symbol 40, as best shown in FIG. 4. One reel, called the "betting" reel is associated with the player's bet to play the base game 8, a second reel, called the "lines" reel, is associated with the number of player-selected pay lines 14 and a third reel, called the "factor" reel is not associated with the player's bet or the number of selected pay lines. The reels have separate probabilities of showing a jackpot symbol 40.

In the embodiment, the betting reel has a reel strip 10 symbols long, of which the number of jackpot symbols 40 on the reel strip varies based on the credits bet per pay line. For example, if the player has bet 1 credit per pay line 14, then the electronic game controller 4 selects a reel strip for the betting reel having only one jackpot symbol 40 on the reel strip. However, if the player has bet 5 credits per pay line 14, then the electronic game controller 4 selects a reel strip for the betting reel having five jackpot symbols 40 on the reel strip. The number of jackpot symbols 40 appearing on the reel strip for the betting reel need not be proportional to the amount bet per pay line 14 but may increment in stepwise amounts. For example, a bet of 10 credits per pay line 40 results in the electronic game controller 4 selecting a reel strip for the betting reel having nine jackpot symbols 40 on the reel strip, not ten jackpot symbols.

Similarly, in the embodiment the lines reel has a reel strip 100 symbols long, of which the number of jackpot symbols 40 on the reel strip varies based on the number of pay lines 14 selected by the player for the play of the base game 8. For example, if the player has selected 50 pay lines 14, the electronic game controller 4 selects a reel strip for the lines reel having 50 jackpot symbols 40 on the reel strip. Again, the number of jackpot symbols 40 appearing on the reel strip for the lines reel need not be proportional to the number of player-selected pay lines 14 but may increment in stepwise amounts, especially as most conventional betting options only provide for a predetermined number of pay lines that can be selected, such as 1 line, 2 lines, 5 lines, 10 lines, 25 lines and 50 lines (where 50 lines are the maximum number of available pay lines 14 in the base game 8) Thus, the number of jackpot symbols 40 that may appear on the lines reel may increment from 5, 10, 25, 33, 40 and 50 out of 100 symbols for 1 line. 2 lines, 5 lines, 10 lines, 25 lines and 50 lines, respectively. This represents probabilities of 5%, 10%, 25%, 33%, 40% and 50%.

The factor reel also has a reel strip of 100 symbols long, but there is only one jackpot symbol 40. The number of jackpot symbols 40 does not change, irrespective of the amount bet by the player (the number of credits bet per pay line 14) or the number of player-selected pay lines 14. In some embodiments, the length of the factor reel can be changed to vary the RTP that would affect the probability across different game variations but within the same game variation the length is always the same regardless of the total bet played. In this context, a "game variation" of a first game means a game having the same game rules as the first game, but with a different RTP % for the gaming machine operator (such as a club venue) to choose from in accordance with the requirements of the gaming machine operator. In other embodiments, the length of the factor reel may be changed so vary the RTP across different feature games 9 offered by the gaming machine 1. However, it is preferred that the length of the factor reel is kept the same across the different feature game 9 or even the same type of feature game 9 (where the game mechanics are the same by the game symbols and associated themes or images are different) offered by the gaming machine 1, irrespective of the total bet made by the player.

It will be appreciated that the length of the reel strips for the betting, lines and factor reels may vary, as desired. Hence, each different RTP % can consist of different sets of reels, which can be the length of the factor reels and may include, base or feature reels, but with the same paytable. Also, the probabilities for the jackpot symbol on each of the betting, lines and factor reels may vary as required by the game designer. In addition, in other embodiments, the feature game 9 may comprise only the three betting, lines and factor reels or having multiple betting, lines and factor reels to further permit variation in the trigger event probability and hence volatility of the game.

In order to trigger the jackpot feature game, the player needs to three jackpot symbols 40 to appear on the feature game array 11, one jackpot symbol on each of the betting, lines and factor reels. This ensures that there is linearity across all the betting options. The term "linearity" in this context means that the probability of the player triggering the jackpot feature game (and hence winning the selected jackpot) increases as the player's bet increases, due to the jackpot feature trigger probability being dependent upon two probability components that are dependent on the player's bet, being the betting and lines reels. The only probability component independent of the bet made by the player is the factor reel, which has a constant probability. This allows more frequent access to the jackpot feature game to encourage the player making larger bets instead of smaller bets so that the RTP % is in the same range. The appearance of the three jackpot symbols 40 in this manner comprises a trigger event for the jackpot feature game.

The electronic game controller 4 selects which of the five reels 12 in the feature game array 11 will be the betting, lines and factor reels. For example, as shown in FIG. 4, the reels 12*b*, 12*c* and 12*e* have been selected as the betting, lines and factor reels and the three jackpot symbols 40 appearing on those reels 12*b*, 12*c*, 12*e* that has triggered the jackpot feature game.

Figure 5:
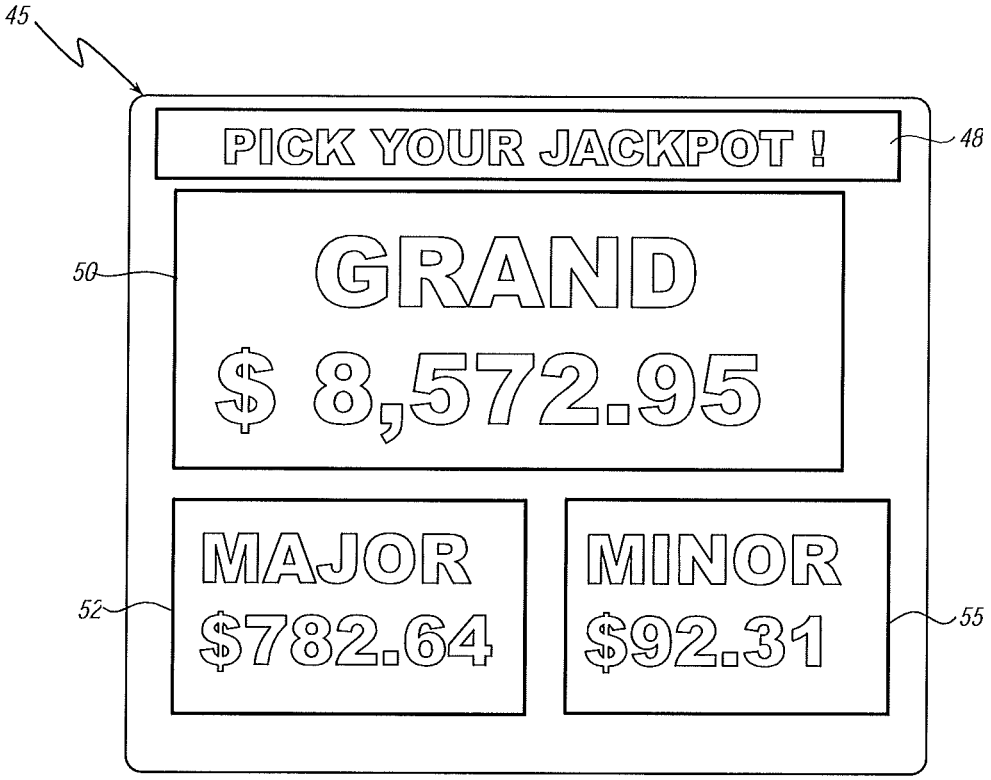
FIG. 5 is a partial simulated screen shot illustrating a jackpot selection screen for the game of FIG. 4.

Once the jackpot feature game is triggered, a selection screen 45 appears on the display as best shown in FIG. 5. The selection screen 45 has a message or title 48 indicating to the player that he or she may select one of the jackpots shown on the selection screen, which in this embodiment comprises a Grand jackpot 50, a Major jackpot 52 and a Minor jackpot 55. In this embodiment, the jackpots 50, 52, 55 are all progressive jackpots. A progressive jackpot prize takes a portion of each bet (typically a set percentage of each bet) made on the gaming machine and thus the amount of the progressive jackpot incrementally increases as more bets are made on the gaming machine 1. The progressive jackpot is typically awarded when a winning game combination associated with the jackpot occurs in the game played on the gaming machine. In many cases, progressive jackpots are associated with the least probable winning combination and are commonly the highest paying award of the gaming machine. In other cases, a separate trigger event can be used to award the progressive jackpot prize, such as a special jackpot symbol, a trigger event internally generated by the electronic game controller. Alternatively, or additionally, once a certain threshold is met, either a certain amount that has been bet on the gaming machine or the incremented amount of the progressive jackpot, a trigger event is activated in the electronic gaming machine to pay out the progressive jackpot prize. Progressive jackpot prizes also tend to be shared amongst multiple gaming machines so as to increase the amount of the progressive jackpot prize and hence increase player interest in playing one of the electronic gaming machines (and hence are often referred to as "linked" progressive jackpots). In some gaming machines, more than one jackpot or progressive jackpot are offered by the gaming machine or gaming machines linked together.

Progressive jackpots can be confined to the gaming machine 1 as so called "standalone" progressive jackpots. Alternatively, the jackpot is a wide area or an in-house linked progressive jackpot prize. In other embodiments, one or more the progressive jackpot prizes are configured to be part of a wide area or in-house linked progressive jackpot prize. In other words, the progressive jackpot prizes can be awarded on a group of networked gaming machines in a specified area or a group of specified gaming machines that are linked together for jackpot purposes (usually via a central jackpot controller). The jackpot prizes can also be shared with any other games offered on the same gaming machine 1 (as in multi-game gaming machines).

Each of the three selectable jackpots 50, 52, 55 has the same RTP value (or substantially the same RTP value) so that the player is indifferent from choosing a different jackpot regardless. In this embodiment, the RPT is kept the same or substantially the same by balancing the probability of winning each of the progressive jackpots 50, 52, 55 and/or fine-tuning the increments paid into those progressive jackpots.

After the player makes a selection of one of the jackpots, the jackpot feature game commences, which determines whether the player wins the selected jackpot. The jackpot feature game can be of any type or scope, such as a pick-a-box type jackpot game (where the player may select from a plurality of boxes or items which reveal credit prizes or the jackpot), special jackpot reel(s) that spin to reveal credit prizes or the jackpot, or the like.

Figure 6:
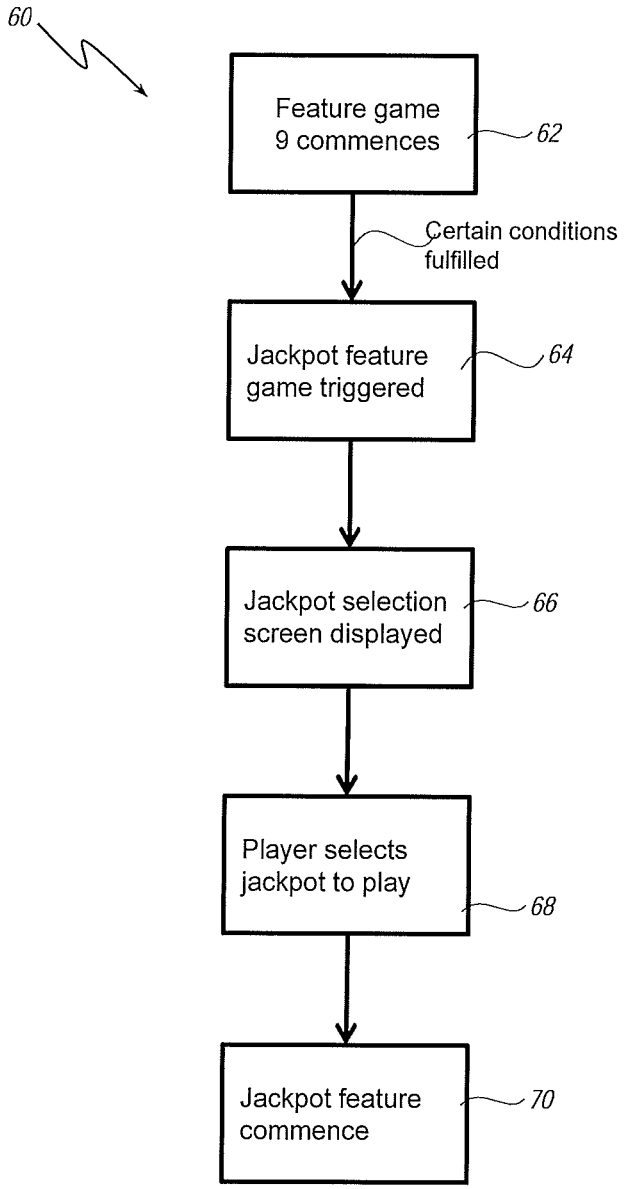
FIG. 6 is a schematic drawing illustrating process in triggering a jackpot feature game.

This process 60 is also illustrated in FIG. 6, where at the feature game 9 commences at step 62, and upon the eligibility criteria being fulfilled, the jackpot feature game is triggered at step 64. The selection screen 45 is then shown at step 66 and the player selects one of the jackpots 50, 52, 55 at step 68. Once a jackpot has been selected, the jackpot feature game commences at step 70.

The benefit of this structure in awarding a player-selected jackpot is that it is mathematical efficient because only one jackpot is being played for in the jackpot feature game. This means that there is no need to reduce the RTP from the base game 8 or the feature game 9 while still be able to offer multiple jackpots on a single gaming machine 1. Consequently, the process of awarding the jackpot feature becomes mathematically more efficient.

Thus, in the embodiment of the invention, the player is able to play for a single jackpot (selected by the player) rather than for all of the jackpots. This enables the game 8, 9 to be mathematically efficient in terms of RTP in that only one RTP % needs to be provided to the jackpot or bonus prizes, instead of having multiple jackpots with their individual RTP %. As a result, the base game 8 and feature game 9 can have higher RTP percentages (since only one RTP % needs to be provided for the jackpot), yet still offer multiple jackpots or bonus prizes at the same time. In this way, there is more freedom for the game designer to tailor the gaming machine to a desired volatility without affecting the overall game design.

The embodiments of the invention also permit a player to choose the volatility of the jackpot. It will be appreciated that one skilled in the art will recognise that the term "volatility" refers to the expected frequency of winning game events occurring and the corresponding amount paid for each winning game event in order to maintain the required payout level set for the gaming machine. Thus, the amount paid for each winning combination and the level of return to the player determines the "volatility" of the gaming machine. For example, a gaming machine with low volatility is configured to have a relatively high frequency of "wins", where each win has a relatively low value. Conversely, high volatility refers to a lower frequency of "wins" of correspondingly higher value. Throughout the specification, "volatility" is a reference to this characteristic of a gaming machine.

Hence, the player is able to select the highest value Grand jackpot 50 even though there a low percentage chance of winning, as opposed to the Minor jackpot 55 that has a higher chance of being won but has a much lower value. In this case, the same or nearly the identical average RTP % is provided across the different jackpots, and so a player has an optimal choice to choose which jackpot to select for the jackpot feature game based on the value of the jackpot meter (being the amount of the jackpot displayed) at that point of time. For example, the value of the Grand jackpot 50 may be lower than the Major jackpot 52 during play of the game due to the different incremented amounts added to each jackpot and/or whether the Grand jackpot has recently been won and so its value has been reset (although the Grand jackpot 50 will eventually exceed the value of the Major jackpot over a certain period). In some embodiments, the jackpot selection screen 45 may display a message indicating to the player what the optimal choice of jackpot will be base on the highest RTP % at that point of time.

Figure 7:
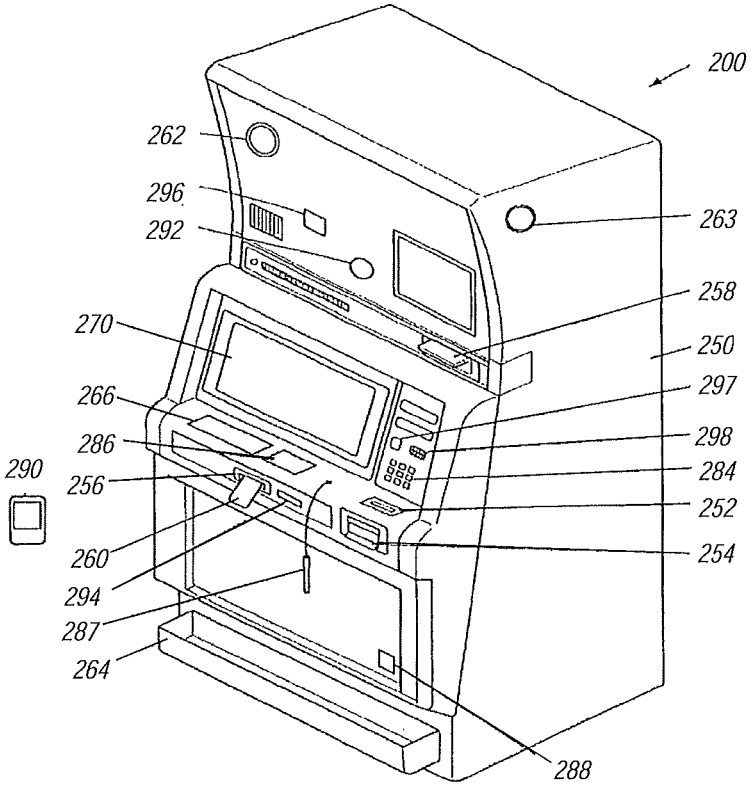
FIG. 7 is a perspective view of an electronic gaming machine according to yet another embodiment of the invention.

Referring to FIG. 7, another embodiment of the invention is shown in the form of an electronic gaming machine 200. The electronic gaming machine 200 may include a housing or cabinet 250 and one or more value transfer mechanisms or devices, which may include a coin slot or acceptor 252, a paper currency or bill acceptor 254, a ticket reader/printer 256 and a card reader 258, which may be used to input value to the electronic gaming machine 200. A value transfer device may include any device that can accept value from a player. The topper (not shown) may be mounted to the top of the electronic gaming machine 200.

If provided on the electronic gaming machine 200, the ticket reader/printer 256 may be used to read and/or print or otherwise encode ticket vouchers 260. The ticket vouchers 260 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 260 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 260 could be printed with an optically readable material such as ink, or data on the ticket vouchers 260 could be magnetically encoded. The ticket reader/printer 256 may be provided with the ability to both read and print ticket vouchers 260, or it may be provided with the ability to only read or only print or encode ticket vouchers 260. In the latter case, for example, some of the electronic gaming machines 200 may have ticket printers 256 that may be used to print ticket vouchers 260, which could then be used by a player in other electronic gaming machines 200 that have ticket readers 256.

If provided, the card reader 258 may include any type of card reading device, such as a magnetic card reader or an optical card reader, and may be used to read data from a card offered by a player, such as a credit card or a player tracking card. If provided for player tracking purposes, the card reader 258 may be used to read data from, and/or write data to, player tracking cards that are capable of storing data representing the identity of a player, the identity of a casino, the players gaming habits, etc.

The electronic gaming machine 200 may include one or more audio speakers 262, a coin payout tray 264, an input control panel 266, and a colour video display unit 270 for displaying images relating to the game or games provided by the electronic gaming machine 200. The audio speakers 262 may generate audio representing sounds such as the noise of spinning reels, a dealer's voice, music, announcements or any other audio related to a game. The input control panel 266 may be provided with a plurality of pushbuttons or touch-sensitive areas that may be pressed by a player to select games, make wagers, make gaming decisions, etc.

Figure 8:
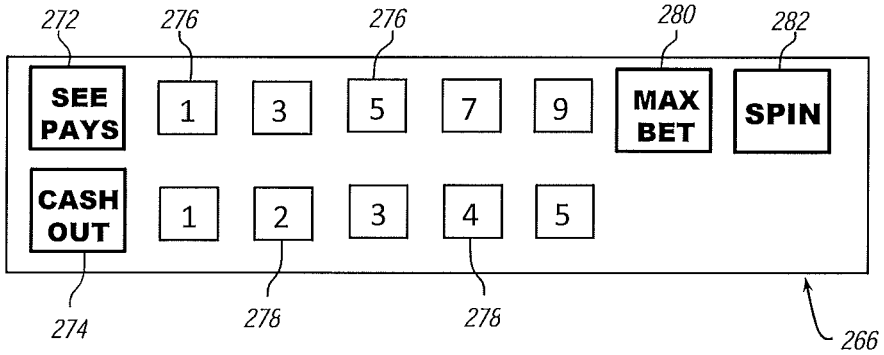
FIG. 8 is a schematic drawing of a control panel for the electronic gaming machine of FIG. 7.

FIG. 8 illustrates one possible embodiment of the control panel 266, which may be used where the electronic gaming machine 200 having a plurality of reels. The control panel 266 may include a "See Pays" button 272 that, when activated, causes the display unit 270 to generate one or more display screens showing the odds or payout information for the game or games provided by the electronic gaming machine 200. As used herein, the term "button" is intended to encompass any device that allows a player to make an input, such as an input device that must be depressed to make an input selection or a display area that a player may simply touch. The control panel 266 may include a "Cash Out" button 274 that may be activated when a player decides to terminate play on the electronic gaming machine 200, in which case the electronic gaming machine 200 may return value to the player, such as by returning a number of coins to the player via the payout tray 264.

The control panel 266 may be provided with a plurality of selection buttons 276, each of which allows the player to select a different number of pay lines prior to spinning the reels. For example, five buttons 276 may be provided, each of which may allow a player to select one, three, five, seven or nine pay lines.

The control panel 266 may also be provided with a plurality of selection buttons 78 each of which allows a player to specify a wager amount for each pay line selected. For example, the electronic gaming machine 200 may be provided with five selection buttons 78, each of which may allow a player to select 10, 20, 50, 100 and 200, to wager for each pay line selected. In that case, if a player were to activate one of the buttons 276 to select five pay lines and then activate one of the buttons 278 to select 5¢ per pay line to be wagered or bet, the total wager would be $0.25.

The control panel 266 may include a "Max Bet" button 280 to allow a player to make the maximum wager allowable for a game. In the above example, where up to nine pay lines were provided and up to 200 could be wagered for each pay line selected, the maximum wager would be $1.80 The control panel 266 may include a spin button 282 to allow the player to initiate spinning of the reels after a bet has been made.

In FIG. 8, a rectangle is shown around the buttons 272, 274, 276, 278, 280, 282. It should be understood that the rectangle simply designates, for ease of reference, an area in which the buttons 272, 274, 276, 278, 280, 282 may be located. Consequently, the term "control panel" should not be construed to imply that a panel or plate separate from the housing 250 of the electronic gaming machine 200 is required, and the term "control panel" may encompass a plurality or grouping of player activatable buttons.

Although one possible control panel 266 is described above, it should be understood that different buttons could be utilized in the control panel 266, and that the particular buttons used may depend on the game or games that could be played on the electronic gaming machine 200. Although the control panel 266 is shown to be separate from the display unit 270, it should be understood that the control panel 266 could be generated by the display unit 270. In that case, each of the buttons of the control panel 266 could be a coloured area generated by the display unit 270, and some type of mechanism may be associated with the display unit 270 to detect when each of the buttons was touched, such as a touch-sensitive screen.

As noted above, the electronic gaming machine 200 may include a mechanism by which the electronic gaming machine 200 may determine the identity of the player. In particular, the card reader 258 may be used to read a card that carries an identification code that may be uniquely associated with the player so that the gaming unit can differentiate that player from all other players, or so that the gaming unit can differentiate that player as a member of a group of players from all player not a member of the group of players. The electronic gaming machine 200 may also include equipment, such as a keypad 284, an input pad 286 (with optional stylus 287), a port (or antenna) 288 adapted to communicate via a wired or wireless link (infrared or radio frequency link, for example) to a mobile electronic device 290 (such as a personal digital assistant, smart phone or tablet), a camera 292, a scanner 294, a retinal (or iris) scanner 296, fingerprint scanner 297, and/or a microphone 298. The electronic gaming machine 200 may include any one of the devices 258, 284, 286, 288, 290, 292, 294, 296, 297, 298, or the electronic gaming machine 200 may include a combination of some or all of the devices 258, 284, 286, 287, 288, 290, 292, 294, 296, 297, 298.

In operation, a player may identify him or herself to the electronic gaming machine 200 by entering a unique numeric or alpha-numeric code using the key pad 284, for example. Alternatively, the player may use his or her finger or the stylus 287 to sign his or her signature on the input pad 286. As a further alternative, the player may sign his or her signature on the mobile electronic device 290, which signature is then converted to electronic data, and the data is then transferred via the port/antenna 288 to the electronic gaming machine 200. As yet another alternative, the player may sign his or her signature on a piece of paper that is then photographed using the camera 292 or scanned using the scanner 294 (or the bill acceptor 254) to convert the signature into electronic data. As an additional alternative, the player may place one of his or her fingers or his or her hand on the scanner 297, and the scanner 297 may generate an electronic data representation of the fingerprint on one or more of the player's fingers or an electronic data representation of the pattern of the entire hand. Alternatively, the camera 292 may be used to take a picture (live or still) of the player, the picture then being converted into electronic data. As a still further alternative, the player may place his or her eye up to the retinal (or iris) scanner 296, and the retinal (or iris) scanner 296 may generate an electronic data representation corresponding to the pattern of the retina (or iris) of the player. As yet another alternative, the player may speak into the microphone 298, and characteristics of the spoken words (or voiceprint) may be converted into an electronic data representation.

Figure 9:
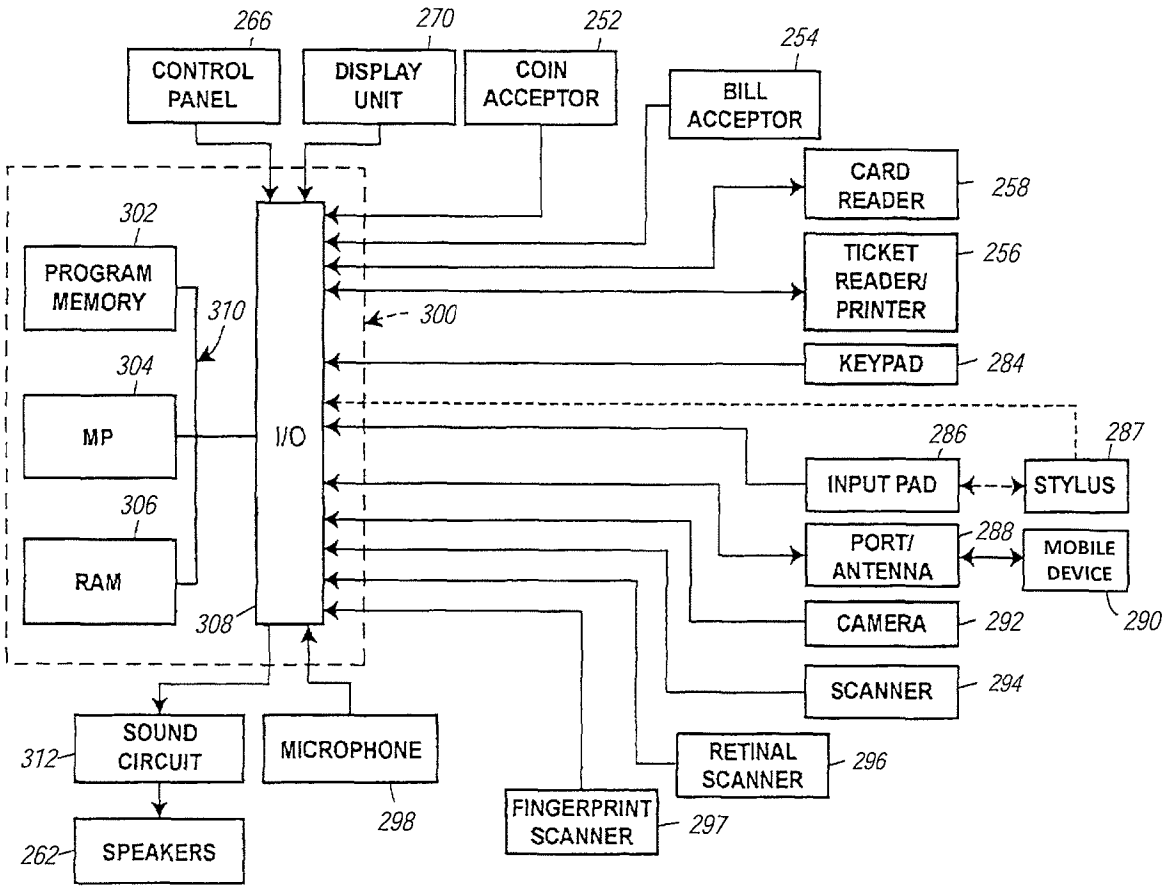
FIG. 9 is a block diagram of the electronic components of the electronic gaming machine of FIG. 7.

FIG. 9 is a block diagram of a number of components that may be incorporated in the electronic gaming machine 200. Referring to FIG. 9, the electronic gaming machine 200 may include a controller 300 that may comprise a program memory 302, a microcontroller or microprocessor (MP) 304, a random-access memory (RAM) 306 and an input/output (I/O) circuit 308, all of which may be interconnected via an address/data bus 310. It should be appreciated that although only one microprocessor 304 is shown, the controller 300 may include multiple microprocessors 304. Similarly, the memory of the controller 300 may include multiple RAMs 306 and multiple program memories 302. Although the I/O circuit 108 is shown as a single block, it should be appreciated that the I/O circuit 308 may include a number of different types of I/O circuits. The RAM(s) 304 and program memories 302 may be implemented as semiconductor memories, magnetically readable memories, and/or optically readable memories, for example.

FIG. 9 illustrates that the coin acceptor 252, the bill acceptor 254, the ticket reader/printer 256, the card reader 258, the control panel 266, the display unit 270, the keypad 284, the input pad 286 (and optionally the stylus 287), the port/antenna 288, the digital camera 292, the scanner 294, the retinal scanner 296, the fingerprint scanner 297 and the microphone 298 may be operatively coupled to the I/O circuit 308, each of those components being so coupled by either a unidirectional or bidirectional, single-line or multiple-line data link, which may depend on the design of the component that is used. The speaker(s) 262 may be operatively coupled to a sound circuit 312, that may comprise a voice- and sound-synthesis circuit or that may comprise a driver circuit. The sound-generating circuit 312 may be coupled to the I/O circuit 308.

As shown in FIG. 9, the components 252, 254, 256, 258, 266, 270, 284, 286, 287, 288, 292, 294, 296, 297, 298, 312 may be connected to the I/O circuit 308 via a respective direct line or conductor. Different connection schemes could be used. For example, one or more of the components shown in FIG. 8 may be connected to the I/O circuit 308 via a common bus or other data link that is shared by a number of components. Furthermore, some of the components may be directly connected to the microprocessor 304 without passing through the I/O circuit 308.

In some embodiments, at least one of the game symbols comprises a game enhancing symbol that confers a game enhancing element to the player. It is further preferred that the game enhancing element modifies the result of a play of the game, which can be any one or combination of the base game 8 and feature game. The game enhancing elements may provide different types of effects or modifications of the game play result. In one embodiment, the game enhancing element comprises the award of one or more plays of the game that do not require a bet from the player. In other words, the game enhancing element awards a predetermined number of "free" games. In some embodiments, the game enhancing element comprises at least one or more a win multiplier, wild multipliers, bonus wilds, symbols that cause the award of additional free games, trigger symbols to retrigger the at least two second arrays, held columns, random wild symbols, stacked symbols, bonus symbols, new game symbols, reveal symbols, progressives, bonus credits, jackpot symbols, and one or more symbol replacements. A variety of game enhancing elements can be awarded by the game enhancing symbols, including:

- symbols that award a predetermined number of free plays of the game;
- win multiplier symbols that multiply the amount of any win from one of the predetermined winning combinations;

"wild" symbols that cause the display of substitute symbols in randomly selected symbol positions;

bonus symbols that awards a bonus prize, either as a monetary amount or as a bonus credit;

wild multiplier symbols that cause the display of substitute symbols on the array 11 and multiplies the amount of any win from one of the predetermined winning combinations;

bonus wild symbols that cause the display of substitute symbols on the array 11 and awards a bonus prize;

symbols that cause the award of additional free plays of the game;

symbols that cause one or more of the symbol positions to be held static (typically one or more reels 12*a* to 12*e*) and display substitute symbols on the array 11;

symbols that cause the same game symbol to be stacked in a group of symbol positions, typically the group being one or more reels 12*a* to 12*e;* symbols that cause the display of new game symbols on the array 11;

"reveal" symbols that cause a game symbol to reveal another game symbol; and

"replacement" symbols that cause one or more game symbols to be replaced by other game symbols in the array 11.

These game enhancing symbols do not modify the function or value of the game symbols 10 that appear on the arrays 11, but instead confer bonus prizes, free games or change existing game symbols for other game symbols (such as replacing picture, royal card or symbols belonging to a reel with wild/substitute symbols). Where the function of game symbols 10 have been changed or the game symbols 10 are replaced, then this modification can take effect with the next play of the game instead of applying to the result of the spun array 11. In another embodiment, the game enhancing symbols may indicate the duration in which its game enhancing element is applied, such as a predetermined number of spins or a predetermined time period.

It will be appreciated that in other embodiments, game enhancing elements can also be awarded as a separate aspect of the games 8, 9. The game enhancing elements may further be awarded in addition or as an alternative to the enhanced prizes awarded based on winning combinations of game symbols 10 in the games 8, 9. In a further embodiment, the award of game enhancing elements can be done by way of a sixth reel or the appearance of game enhancing symbols in the reels 12*a* to 12*e*. The sixth reel in this case is simply added as an extension to the array 11 and spins either game enhancing symbols or "blank" symbols.

In some embodiments, the game enhancing symbols include "collector"-type game enhancing symbols which award points or tokens. The collection of points or tokens during the base game 8 and/or feature game 9 leads to the trigger of additional prizes or game enhancing symbols, depending on the number of points or tokens that are collected. These additional prizes can include stand alone progressive jackpots, bonus prizes and super games, which are enhanced versions of free spins or games where there are greater pay outs or frequency of wins.

In other preferred forms, the game enhancing element can be an enhanced version of the array 11. The enhanced array may provide additional game enhancing symbols that include the award of points or an additional number of free spins of the array 11 (for example, retriggering 5 more free spins). The collection of points awarded by the enhanced array during free spins or game leads to the trigger of additional prizes or game enhancing symbols, depending on the number of points that are collected. These additional prizes can include stand alone progressive jackpots, bonus prizes and super games, which are enhanced versions of free spins or games where there are greater pay outs or frequency of wins. In addition, the enhanced array has a different visual representation to the array 11. In addition, the enhanced array may provide game enhancing symbols of greater value and/or frequency compared to the array 11.

In some embodiments, other types of jackpots may be awarded, such as a fixed jackpot, mystery jackpot, symbol driven jackpot and any combination thereof (i.e. a mixture of different types of jackpots). In some embodiments, the jackpots are limited to the feature game 9. In other embodiments, the jackpots are shared by all the games 8 and 9. That is, the jackpots could be won through play of the games 8 and, 9.

A mystery jackpot is a jackpot that is won independently from a displayed symbol or symbols, unlike symbol driven jackpots. That is, none of the symbols in the game trigger the jackpot; hence the trigger event is a "mystery". By way of comparison, a standard jackpot is typically symbol driven in that a particular combination of symbols must occur in the game to trigger the standard jackpot.

The trigger event for the mystery jackpot can be one randomly generated by the electronic game controller 4 for each play of the games 8 and 9. One way to implement the random determination of the trigger event is for the electronic game controller 4 to internally generate a random number and check if it is a predetermined number or within a predetermined range of numbers that will initiate the appearance of the trigger symbols. For example, the predetermined range of numbers could be the range of numbers between 1 and 10 and the electronic game controller 4 internally generates a random number between 1 and 100. If the generated number is any one of numbers 1 to 10, then this results in the electronic game controller 4 causing the trigger event to occur and award the progressive jackpot prize. It will be appreciated that this manner of determining the trigger event may also be used to determine whether the feature game 9 is triggered in the base game 8.

During play of the games 8 and 9, the electronic game controller 4 will determine whether the trigger event for the jackpot has occurred. In response to the occurrence of the jackpot trigger event(s), the electronic game controller 4 transmits a signal to the video screen 7 to cause the jackpot (s) associated with the jackpot trigger event(s) to be awarded to the player. After the jackpot(s) are awarded, the amounts for any awarded jackpots are reset. The amounts of the jackpots that have been won can be reset either to a predetermined start amount or simply increment upwardly from zero where the won jackpot is a progressive jackpot.

In some embodiments, the in-game trigger event is determined at the end or during the play of the game; i.e. at the end or during a spin of the reels 12. In some embodiments, the in-game trigger event occurs in a preceding play of the game so that the result of the in-game trigger event takes place in a subsequent play of the game, typically the next play of the game after the preceding play but could include a later successive play of the game.

Furthermore, the embodiments of the invention have been described as providing a standard 5×3 array for the base game 8 and the feature game 9. However, it will be appreciated that in other embodiments, the size and shape of the base game array 11 and feature game array may vary as desired. For example, the arrays 11 could take any number of different shapes, such as triangular, circular, square, hexagonal, hemi-spherical or other polygonal shapes. For example, the base game array 11 could comprise a circular array having three rings (equivalent to rows) like a bullseye target segmented into five columns. The feature game array would then expand into additional rings surrounding the initial rings of the base game array 11. Alternatively, the arrays 11 could have an unequal number of rows or columns. For example, the reels 12*a*, 12*b* could have three rows, but the reels 12*c* to 12*e* could have four rows.

While the preferred embodiment of the invention has been described in relation to feature game 9, those skilled in the art will appreciate that the provision of the selectable jackpot or bonus prize can readily be applied to the base game 8 alone or the base game 8 and the feature game 9 together.

In a further variation to the embodiments, each game or symbol position 13 comprises its own individual reel and three of the reels are grouped into columns 12*a* to 12*c* of reels. That is, each symbol position 13 has its own individual reel strip of game symbols.

In other embodiments, the gaming machine 1 also offers the player the opportunity to play in community games against other players in so-called tournament games, or even in player versus player games. This is typically implemented by electronically linking several gaming machines 1 in a group within a gaming venue. The player versus player or tournament game can be played simultaneously by the players or can be staggered, with some players playing at one time and some players playing at another time in the same game. In this situation, the player versus player or tournament game comprises the award of an additional bonus prize in addition to the jackpot prizes in said selected available jackpot set.

While the same game format is essentially used across the base game 8 and feature game 9, it will be appreciated that the game format may vary across the base and feature games, as well as between base games where more than one game is offered by the same electronic gaming machine 1. For example, one of the games 8 may be a wheel-type game or a four reel game and another of the games may be a standard five reel game. Similarly, the games 8 may each have different game symbols, game rules and pay tables that are unique to each game.

While one embodiment of the invention has been described in relation to a base game 8 and a feature game 9, it will be appreciated that the invention could include one or more additional feature games that are triggered by specific trigger symbols appearing in the feature game 9. Also, the additional feature games may also have trigger symbols that trigger further feature games in a cascading fashion. These additional and further feature games could have the same game play elements as the feature game 9 or be different feature games entirely.

In other embodiments, the base game 8 and the feature game 9 need not be displayed alternately on a single video screen 7. Instead, they may be displayed on the same video screen 7, with the base game 8 shown in the lower playing area 7*a* and the feature game 9 shown in the upper display area of the video screen 7. Alternatively, the base game 8 and the feature game 9 are shown on separate video screens, with the base game 8 shown in a lower video screen corresponding to the lower playing area 7*a* and the feature game 9 shown in an upper video screen corresponding to the upper display area. Also, the order can be reversed, with the lower playing area 7*a* or video screen showing the feature game 9 and the upper video screen or upper playing area of a single video display screen 7 showing the base game 8.

In another embodiment, the video screen 7 is a touch screen for use in addition to the player-actuatable buttons 6 so as to enable the player to select the bet level (such as bet denominations or bet per pay line 14) as well as other various features, such as making monetary bets for the game, initiating play of any base and feature games played and responding to any messages or requests issued on the gaming machine 1 by the electronic game controller 4. In this case, the player may control when the reels 12 start spinning and stop spinning, either individually or collectively, by simply touching the reels 12. Control over spinning of the reels 12 can also be implemented through the buttons 6 on the console 3. This increases player interaction and provide the player with an opportunity to guess when a particular game symbol 10 may appear in the reels 12.

In some embodiments, in response to a feature game trigger event in the base game, the game controller causes the display to display game symbols for playing the feature game. Alternatively, the game controller causes the display of the feature game and the base game during play of the base game, the feature game being inactive until triggered. In this embodiment, the change in the feature game from being inactive to active may be indicated on the display. This indication may be visual, aural or a combination of both.

In some embodiments, the gaming machine comprises an input device for receiving commands from the player to play the game, wherein the input device comprises one or more buttons in electronic communication with the game controller to transmit the player commands to the game controller.

In some embodiments, the input device comprises one or more buttons on the housing, the buttons being in electronic communication with the game controller. In other embodiments, the buttons are arranged on a console of the housing. Alternatively or additionally, the input device comprises a touch sensitive surface on the display for receiving commands from the player, the touch sensitive surface being in electronic communication with the electronic game controller to transmit the player commands to the game controller.

In some embodiments, the gaming machine comprises a value transfer mechanism for receiving value from the player to make a bet and initiate a play of the game. In other embodiments, the value transfer mechanism also pays the prizes to the player using value in an amount equal to an awarded prize. It is further preferred that the housing comprises the value transfer mechanism. In one embodiment, the value transfer mechanism comprises one or more vending slots for paying and/or receiving value. In other embodiments, the value transfer mechanism comprises a value input/value output device. In further embodiments, the value transfer mechanism comprises a coin slot or acceptor, a paper currency acceptor, a ticket reader and/or printer or a card reader and/or writer.

In some embodiments, the independent probability component comprises a predetermined probability. Preferably, the independent probability component is constant between plays of said game. Alternatively, the independent probability component varies between plays of said game.

In some embodiments, the trigger event probability comprises multiple probability components.

In some embodiments, the trigger event comprises the appearance of at least one or more bonus symbols in the game, the probability of at least one of the bonus symbols appearing being the probability component that is independent of the value received from the player.

In some embodiments, the trigger event probability comprises a component based on the value received from the player. Preferably, the value based component comprises the bet made by the player for a single play of the game.

In some embodiments, the game comprises randomly selected game symbols displayed in an array of game positions and predefined combinations of the game positions are selectable by the player. Preferably, the trigger event probability comprises a component based on the credits bet per predefined combination of game positions. In one embodiment, the trigger event comprises the appearance of at least one or more bonus symbols in the game, the probability of at least one of the bonus symbols appearing being the probability component based on the credits bet per predefined combination of game positions. Alternatively or additionally, it is preferred that the trigger event probability comprises a component based on the number of predefined combinations of game positions selected by the player. In preferred form, the trigger event comprises the appearance of at least one or more bonus symbols in the game, the probability of at least one of the bonus symbols appearing being the probability component based on the number of predefined combinations of game positions selected by the player.

In some embodiments, the bonus prizes are displayed on the display for selection by the player.

In some embodiments, one of the bonus prizes comprises a progressive jackpot. Preferably, the progressive jackpot is a standalone progressive jackpot. Alternatively, the progressive jackpot is a linked progressive jackpot.

In some embodiments, the gaming machine indicates the optimal selection of the first bonus prize to the player. Preferably, the bonus prizes are displayed on the display for selection by the player with the indication of optimal selection.

In some embodiments, each the game position comprises a reel separate to the other game positions.

In some embodiments, the game enhancing element comprises at least one or more of a predetermined number of free games, a win multiplier, wild multipliers, bonus wilds, symbols that cause the award of additional free games, trigger symbols to retrigger said at least two second arrays, held columns, random wild symbols, stacked symbols, bonus symbols, new game symbols, reveal symbols, progressives, bonus credits, jackpot symbols, and one or more symbol replacements.

In some embodiments, said base game and said feature game each comprises an array of rows and columns of said predetermined game positions, and said base game array is different in size and/or dimensions to said feature game array. In other embodiments, said feature game array is greater in size than said base game array. In one preferred form, said base array comprises three rows and five columns and said feature game array comprises either more than three rows or more than five columns. In a further preferred form, said feature game array is an extended base game array.

In some embodiments, a feature game trigger event occurs in said base game to trigger said feature game. In one embodiment, said feature game trigger event comprises a random event determined by the electronic game controller at the start of play of said feature game. In another embodiment, the feature game trigger event comprises the appearance of at least one trigger symbol in said base game array. In another alternative, the feature game trigger event comprises an in-game event during play of the base game.

In some embodiments, said array (including the base game array and/or the feature game array) take any one of a circular, triangular, oval, semi-circular, hexagonal, pentagonal, octagonal, non-rectangular or polygonal shape. In one preferred form, said wheels and said enhanced wheels arrays take the form of partially shown circular wheels.

In some embodiments, the player selectively starts and/or stops play of said base game array and/or said feature game array.

In some embodiments, the gaming machine comprises a mobile electronic gaming device. In other embodiments, said mobile electronic gaming device comprises a handheld electronic device. In one preferred form, said handheld electronic device comprises a handheld electronic gaming device or a smart phone. Alternatively, said gaming machine comprises a computer. In other embodiments, said computer is connected to a communication network.

In some embodiments, the method comprises providing the independent probability component as a predetermined probability. Preferably, the method comprises providing a constant independent probability component between plays of said game. Alternatively, the method comprises providing a variable independent probability component that varies between plays of said game.

In some embodiments, the method comprises providing the trigger event probability with multiple probability components.

In some embodiments, the method comprises providing the appearance of at least one or more bonus symbols as the trigger event, the probability of at least one of the bonus symbols appearing being the probability component that is independent of the value received from the player.

In some embodiments, the method comprises providing the trigger event probability with a component based on the value received from the player. Preferably, the value based component comprises the bet made by the player for a single play of the game.

In some embodiments, the method comprises providing the game as comprising randomly selected game symbols displayed in an array of game positions and predefined combinations of the game positions are selectable by the player. Preferably, the method comprises providing the trigger event probability with a component based on the credits bet per predefined combination of game positions. In one embodiment, the method comprises providing the appearance of at least one or more bonus symbols as the trigger event, the probability of at least one of the bonus symbols appearing being the probability component based on the credits bet per predefined combination of game positions. Alternatively or additionally, it is preferred that the method comprises providing the trigger event probability with a component based on the number of predefined combinations of game positions selected by the player. In one preferred form, the method comprises providing the appearance of at least one or more bonus symbols as the trigger event, the probability of at least one of the bonus symbols appearing being the probability component based on the number of predefined combinations of game positions selected by the player.

In some embodiments, the method comprises displaying the bonus prizes on the display for selection by the player.

In some embodiments, the method comprises indicating the optimal selection of the first bonus prize to the player. Preferably, the method comprises displaying the bonus prizes on the display for selection by the player with the indication of optimal selection.

In some embodiments, said base game and said feature game each comprises an array of rows and columns of said predetermined game positions, and said method further comprises displaying said base game array in a different size and/or dimensions to said feature game array. In one preferred form, the method comprises providing the feature game array that is greater in size than said base game array.

In another preferred form, the method comprises providing said base array with three rows and five columns and said feature game array with either more than three rows or more than five columns.

It will be appreciated that while the preferred embodiments have been described in relation to an industry standard electronic gaming machine, the invention can be readily applied to other types of electronic gaming machines, including a personal computer (standing alone or connected to a communications network. LAN or WAN), mobile electronic devices (such as handheld or portable electronic devices like tablets and smart phones) and other electronic devices capable of displaying a game. In the case of mobile electronic device, in one arrangement it may permit the player to make bets using "virtual" credits that represent a monetary value, but do not require the player to make a monetary transaction. Instead, the invention may provide a tiered access to the various features of the game so that the player can make relatively small payments to access particular features of the game or obtain additional benefits during game play. An alternative arrangement would require the player to purchase virtual credits or tokens via an interface on the mobile electronic device or an online interface accessible by the mobile electronic device. Similarly, either of the above described arrangements can be applied where the invention is implemented on a personal computer (PC) connected to the internet (wirelessly or not). In one example of the implementation, the PC would access an online casino over the internet to play the game of the invention or the game of the invention would be part of a social networking website. It is also contemplated that the player could also make regular payments to subscribe to continue playing the game on the mobile electronic device, PC or other electronic device.

In an alternative embodiment, the gaming machine also provides an option for the player to play with either credits based on a monetary amount or virtual credits as discussed above. This can be implemented by way of a selection menu prior to playing the selected game or by providing a suitable menu button on screen during play of the selected game.

In another aspect, the invention includes a computer programme configured to perform the invention. In this way the invention can be implemented in various ways on a gaming machine. In a further aspect, the invention includes a gaming system configured comprising a central processing unit (such as a computer or computational processor) configured for communication with a gaming machine to perform the invention. In a yet another aspect, the invention includes a non-transitory computer readable or carrier medium carrying computer executable code that, when executed on a central processing unit configured for communication with a gaming machine, causes said central processing unit to perform the invention. In this case, the non-transitory carrier medium includes an external hard drive, a memory device, including a memory card, smart card, a radio frequency identification (RFID) device, USB key, magnetic card or other electronic storage device.

While the illustrated embodiments include an electronic display on which the array of game positions is displayed, it will be recognized that the disclosed embodiments could instead incorporate mechanical or electro-mechanical reels to define the array of game positions. In fact, to the extent that the game positions, game symbols or operation of the gaming machine described herein would require a modification of such mechanical or electro-mechanical reels, it will be recognized that the embodiment represents a change in the structure or operation of a machine, rather than simply a variation in the rules of playing a game. In addition or in the alternative, the variation in the game positions, game symbols or operation of the gaming machine described herein may be viewed as analogous to a method for utilizing a new game apparatus (like a new deck of cards), rather than simply as a new set of rules in and of themselves.

It will further be appreciated that any of the features in the preferred embodiments of the invention can be combined together and are not necessarily applied in isolation from each other. For example, the feature of the player being able to selectively starting or stopping spinning of the reels 12 and the feature of providing separate video screens for the lower playing area 7*a* and upper display area 7*b* can be combined into a single gaming machine 1. Similar combinations of two or more features from the above described embodiments or embodiments of the invention can be readily made by one skilled in the art.

By providing the ability to select one jackpot or bonus prize to be won with a trigger event probability having a component independent of the bet made by a player, the award of the jackpot or bonus prize is mathematically efficient since it permits the maximum possible RTP to be allocated to the base and/or feature games while still be able to offer multiple jackpots or bonus prizes on the gaming machine. This improves operation of the gaming machine while retaining the player's ability to choose the level of volatility in the game being played. Furthermore, since the game controller controls operation of the gaming machine, the invention can be readily implemented to existing gaming machines, including EGMs, electro-mechanical or purely mechanical gaming machines as well as other gaming systems. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. A gaming machine comprising:

a display for displaying a game, wherein said game comprises display of randomly selected game symbols in game positions in a plurality of reels and predetermined winning combinations of said randomly selected game symbols in said game award prizes to a player, predefined combinations of said game positions being selectable by said player;

a game controller for controlling the display of said game symbols on said display, the game controller comprising a processor and memory; and a value transfer mechanism for receiving value from said player, said value transfer mechanism comprises one of a coin acceptor, a bill acceptor and a ticket reader/printer, wherein said game controller is configured to communicate with said value transfer mechanism such that when a threshold amount of value has been received by said value transfer mechanism, said game controller is configured to initiate a play of said game;

wherein said game controller is configured to determine whether a trigger event has occurred in said play of said game, said trigger event comprising a bonus symbol appearing on a first reel, the bonus symbol appearing on a second reel, and the bonus symbol appearing on a third reel, a probability of the bonus symbol appearing on the first reel varies according to an amount of value bet per predefined combination of game positions, a probability of the bonus symbol appearing on the second reel varies according to a number of predefined combinations of game positions selected and a probability of the bonus symbol appearing on the third reel is independent of the value received from said player;

upon occurrence of said trigger event, said game controller is configured to offer a plurality of bonus prizes for selection by said player;

wherein said game controller is configured to receive a selection from said player of a first bonus prize of said bonus prizes; and said game controller is configured to cause said first bonus prize to only be available during play of said game.

2. The gaming machine of claim 1, wherein the probability of the bonus symbol appearing on the third reel is a predetermined probability.

3. The gaming machine of claim 2, wherein the probability of the bonus symbol appearing on the third reel is constant between plays of said game.

4. The gaming machine of claim 2, wherein the probability of the bonus symbol appearing on the third reel varies between plays of said game.

5. The gaming machine of claim 1, wherein said bonus prizes are displayed on said display for selection by said player.

6. The gaming machine of claim 1, wherein one of said bonus prizes comprises a progressive jackpot.

7. The gaming machine of claim 6, wherein said progressive jackpot is a standalone progressive jackpot.

8. The gaming machine of claim 6, wherein said progressive jackpot is a linked progressive jackpot.

9. The gaming machine of claim 1, wherein said gaming machine indicates an optimal selection of said first bonus prize to said player.

10. The gaming machine of claim 9, wherein said bonus prizes are displayed on said display for selection by said player with said indication of the optimal selection.

11. The gaming machine of claim 1, wherein the probability of the bonus symbol appearing on the first reel is varied by increasing a number of the bonus symbol on a reel strip associated with the first reel as the amount of value bet per predefined combination of game positions increases.

12. The gaming machine of claim 1, wherein the probability of the bonus symbol appearing on the second reel is varied by increasing a number of the bonus symbol on a reel strip associated with the second reel as the number of predefined combinations of game positions increases.

13. The gaming machine of claim 1, wherein the probability of the bonus symbol appearing on the first reel is varied by increasing a number of the bonus symbol on a reel strip associated with the first reel as the amount of value bet per predefined combination of game positions increases, and the probability of the bonus symbol appearing on the second reel is varied by increasing a number of the bonus symbol on a reel strip associated with the second reel as the number of predefined combinations of game positions increases.

14. The gaming machine of claim 13, wherein the probability of the bonus symbol appearing on the third reel is constant between plays of said game.

15. The gaming machine of claim 13, wherein the probability of the bonus symbol appearing on the third reel varies between plays of said game.

16. The gaming machine of claim 1, wherein the probability of the bonus symbol appearing on the third reel varies by changing a length of a reel strip associated with the third reel.

17. The gaming machine of claim 16, wherein the length of the reel strip associated with the third reel is changed to vary a return to player percentage.

* * * * *